US006457209B1

(12) United States Patent
Breuer et al.

(10) Patent No.: US 6,457,209 B1
(45) **Date of Patent: *Oct. 1, 2002**

(54) METHOD OF DIRECTLY DETERMINING SETTING VALUES FOR THE APPLICATION POINT OF REGULATION IN A REGULATED DRAW FRAME

(75) Inventors: Joachim Breuer, Aachen; Reinhard Hartung, Mönchengladbach, both of (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/938,839

(22) Filed: Aug. 27, 2001

(30) Foreign Application Priority Data

Aug. 25, 2000 (DE) ..... 100 41 892

(51) Int. Cl.[7] ..... D01H 5/32
(52) U.S. Cl. ..... 19/239; 19/150; 19/240
(58) Field of Search ..... 19/150, 157, 236, 19/237, 238, 239, 240, 256, 258, 260

(56) References Cited

U.S. PATENT DOCUMENTS 4,819,301 A * 4/1989 Konig et al. ..... 19/240
5,461,757 A * 10/1995 Leifeld ..... 19/150
5,583,781 A * 12/1996 Denz et al. ..... 19/236
5,771,542 A * 6/1998 Dammig ..... 19/236
5,815,890 A * 10/1998 Leifeld ..... 19/150
6,088,882 A 7/2000 Leifeld

FOREIGN PATENT DOCUMENTS

DE 44 04 326 10/1994
DE 195 37 983 4/1997

* cited by examiner

*Primary Examiner*—Danny Worrell
*Assistant Examiner*—Gary L. Welch
(74) *Attorney, Agent, or Firm*—Venable; Gabor J. Kelemen

(57) ABSTRACT

A method of directly determining setting values for an application point of regulation in a draw unit for drafting sliver includes the following steps: Obtaining at least three measured values of a quality-characterizing magnitude, such as the CV value, of the drafted sliver; utilizing the measured values for formulating a function having a minimum constituting an optimal application point of regulation for controlling the draw unit; determining the optimal application point of regulation in a pre-operational run of the draw unit; and numerically computing a function between the quality-characterizing magnitudes and application points of regulation from the measured values.

19 Claims, 2 Drawing Sheets

METHOD OF DIRECTLY DETERMINING SETTING VALUES FOR THE APPLICATION POINT OF REGULATION IN A REGULATED DRAW FRAME

CROSS REFERENCE TO RELATED APPLICATION

This application claims the priority of German Application No. 100 41 892.9 filed Aug. 25, 2000, which is incorporated herein by reference.

BACKGROUND OF THE INVENTION

This invention relates to a method of directly determining setting values for the application point of regulation in a regulated draw frame for slivers. The control system of the draw frame in which the extent of draft of the sliver may be set has at least one preliminary control system for changing the draft of the sliver. Based on the drafted sliver, a number of quality-characterizing measured values, such as CV values may be sensed and utilized for formulating a function whose minimum represents an optimum application point of regulation for the control of the draw frame. The optimized application point of regulation may be determined in a pre-operational test run or a setting run of the draw frame.

The application point of regulation is an important setting magnitude in a draw frame to produce slivers with a high sliver uniformity, that is, with a small CV value.

In a known system, during a pre-operational setting run, the sliver is drafted between the mid rolls and the output rolls of the draw unit and is withdrawn by calender rolls which are adjoined by a measuring device for the CV value of the drafted sliver. In the pre-operational setting run a plurality of CV values are determined which represent a quality-characterizing magnitude for the drafted sliver. Based on such measured values, a function is formulated whose minimum value corresponds to a value which promises to be the best adaptation of the regulation actual sliver. The plurality of measured values which are plotted and based on which the function is formulated, are in each instance measured for a different setting value of the regulation. Thus, for the definition of the function to be evaluated, each incremental value of an incrementally changing parameter, for example, the application point of regulation of the "electronic memory", has to be associated with one of the measured values. For this purpose, on command, the control system sets, in the preliminary control system, an arbitrary, in most cases estimated, first value $R_{min}$ obtained from empirical values (for example, from a table) for the application point of regulation.

After passage of a certain sliver quantity which should be just as long that an unequivocal CV value may be calculated therefrom, a CV value designated $Cv_1$ is maintained fixed. This measured value taken from the measuring device is applied to a memory of the control system. Thereafter the first set application point of regulation R of the preliminary control is changed by at least one incremental magnitude. Again, the sliver is allowed to run for a certain time period until a corresponding $CV_2$ value is stored by the control system into the same memory range. In a similar manner a further incrementing of the application point of regulation is effected and a further measurement of a $CV_3$ value takes place, until a number of values is available between a minimum application point of regulation $R_{min}$ and a maximum application point of regulation $R_{max}$. The distances between two measured values are identical to obtain a displacement-constant scanning (uniform distance of the measured values). A secured, storage-ready value as a quality value for the function becomes available only when the measurement of the CV value has occurred in a sufficiently large number of individual measurements.

It is a disadvantage of the above-outlined system that the minimum value is determined by a time-consuming search. In this process, starting from $R_{min}$ one proceeds in small steps along the function curve until the $R_{max}$ value is reached. This involves a great number of measurements in small, incremental steps which is a complex procedure.

SUMMARY OF THE INVENTION

It is an object of the invention to provide an improved method of the above-outlined type from which the discussed disadvantages are eliminated and which in particular, ameliorates the determination and setting of the optimal application point of regulation at the regulating system of a draw unit and, more particularly, allows a more rapid determination of the application point of regulation. It is a further object of the invention to provide a method which also takes into consideration different, quality-characterizing magnitudes, such as different CV values.

These objects and others to become apparent as the specification progresses, are accomplished by the invention, according to which, briefly stated, the method of directly determining setting values for an application point of regulation in a draw unit for drafting sliver includes the following steps: obtaining at least three measured values of a quality-characterizing magnitude, such as the CV value, of the drafted sliver; utilizing the measured values for formulating a function having a minimum constituting an optimal application point of regulation for controlling the draw unit; determining the optimal application point of regulation in a pre-operational run of the draw unit; and numerically computing a function between the quality-characterizing magnitudes and application points of regulation from the measured values.

The optimal application point of regulation (optimal dead period or delay) is determined by the draw frame itself by using the steps according to the invention. Based on the CV values of the sliver measured on line, the draw frame control system determines the optimal application point of regulation, that is, the machine optimizes itself. By the placement of as few as three measured values ($R_{min}$, $R_{max}$ and an intermediate value $R_x$) it is feasible to rapidly calculate the minimum of the function and thus the optimized application point of regulation. By virtue of the fact that only few measured values need to be taken and suffice for the calculation, it is feasible in a simple manner to achieve a double time-reduction, that is, a more rapid determination of the optimized application point of regulation. The time saving further makes possible to take into consideration different, further quality-characterizing magnitudes whereby an even more accurate determination of the optimized application point of regulation is feasible.

DESCRIPTION OF THE PREFERRED EMBODIMENT

Figure 1:
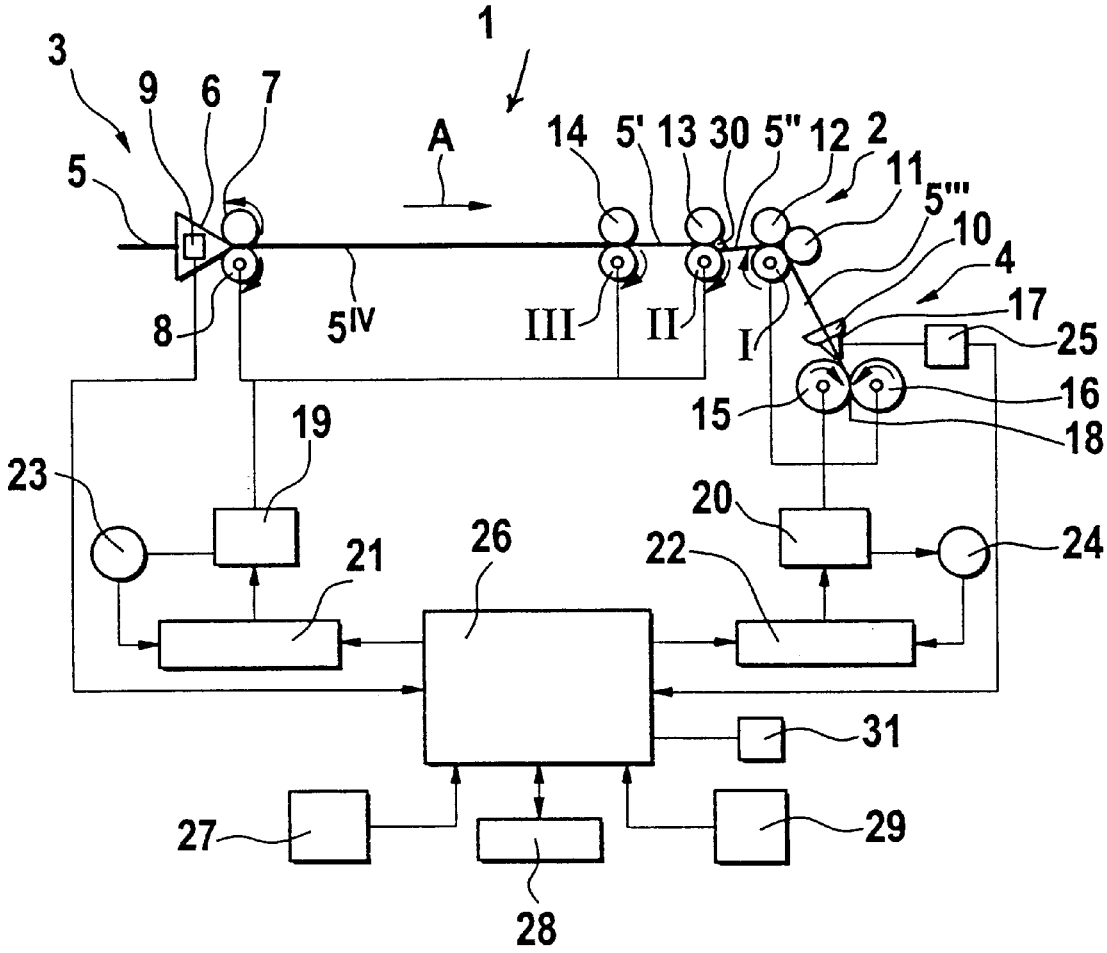
FIG. 1 is a schematic side elevational view of a regulated draw frame including a system for practicing the invention.

FIG. 1 illustrates a draw frame 1 which may be, for example, an HSR model manufactured by Trutzschler GmbH & Co. KG, Monchengladbach, Germany.

The draw frame 1 includes a draw unit 2 having an upstream draw unit inlet 3 and a downstream draw unit outlet 4. The slivers 5 are taken from non-illustrated coiler cans and are introduced into a sliver guide 6 which includes a measuring member 9 and from which they are withdrawn by calender rolls 7, 8.

The draw unit 2 is a 4-over-3 construction, that is, it is formed of a lower output roll I, a lower middle roll II and a lower input roll III as well as four upper rolls 11, 12, 13 and 14. The draw unit 2 drafts the sliver 5, composed of a plurality of slivers, in a preliminary and principal drafting field. The roll pairs III,14 and II,13 constitute the preliminary drafting field for drafting the sliver portion 5' whereas the roll assembly II,11,13 and the roll pair I,12 constitute the principal drafting field for drafting the sliver portion 5". The roll pair II,13 is immediately followed by a pressure bar 30. The drafted slivers 5 are introduced in the draw unit outlet 4 into a sliver guide 10 and are, by means of calender rolls 15, 16, pulled through a sliver trumpet 17 in which the slivers are combined into a single sliver 18 which is subsequently deposited in coiler cans. The direction of the sliver passing through the draw frame 1 is designated at A, and the sliver portion between the roll pairs 7, 8 and III, 14 is designated at $5^{IV}$.

The calender rolls 7, 8, the lower input roll III and the lower middle roll II which are mechanically coupled to one another, for example, by means of a toothed belt, are driven by a regulating motor 19 to which a desired rpm value may be applied. The respective upper rolls 14 and 13 are driven by the respective lower rolls by friction. The lower output roll I and the calender rolls 15, 16 are driven by a principal motor 20. The regulating motor 19 and the principal motor 20 each have a respective regulator 21, 22. Each rpm regulation occurs by means of a closed regulating circuit which includes a tachogenerator 23 connected with the motor 19 and the regulator 21, as well as a tachogenerator 24 connected with the motor 20 and the regulator 22.

At the draw unit inlet 3 a mass-proportionate magnitude, for example, the sliver cross section is measured by the inlet measuring organ 9 which is known, for example, from German patent document DE-A-44 04 326. At the draw unit outlet 4 the cross section of the exiting sliver 18 is sensed by an outlet measuring member 25 which is associated with the sliver trumpet 17 and which is known, for example, from German patent document DE-A-195 37 983. A central computer unit 26 (control and regulating device), for example, a microcomputer with microprocessor, transmits a setting of the desired value to the regulator 21 for the regulating motor 19. The measured values from both measuring members 9 and 25 are transmitted to the central computer unit 26 during the drafting process. The desired rpm value for the regulating motor 19 is determined by the central computer unit 26 from the measured values sensed by the intake measuring member 9 and from the desired value for the cross section of the exiting sliver 18. The measured values of the outlet measuring member 25 serve for monitoring the exiting sliver 18. With the aid of such a regulating system fluctuations in the cross section of the inputted slivers 5 may be compensated for by suitable regulation of the drafting process to obtain an evening of the sliver. A monitor 27, an interface 28, an inputting device 29 and a memory 31 are also connected to the computer 26.

Figure 1A:
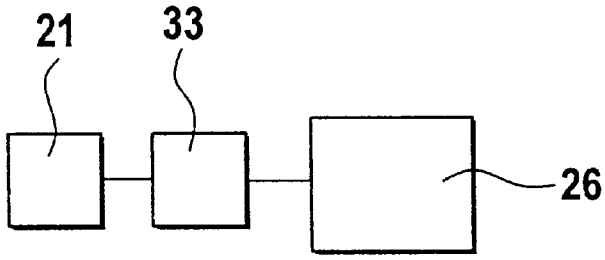
FIG. 1*a* is a block diagram of a separate preliminary control device.

While the preliminary control system may be integrated into the central computer unit 26 as shown in FIG. 1, according to FIG. 1*a*, a separate preliminary control system 33 may be provided which is connected between the computer unit 26 and the regulator 21. The computer unit 26 changes the application point of regulation R of the preliminary control system 33.

Figure 2:
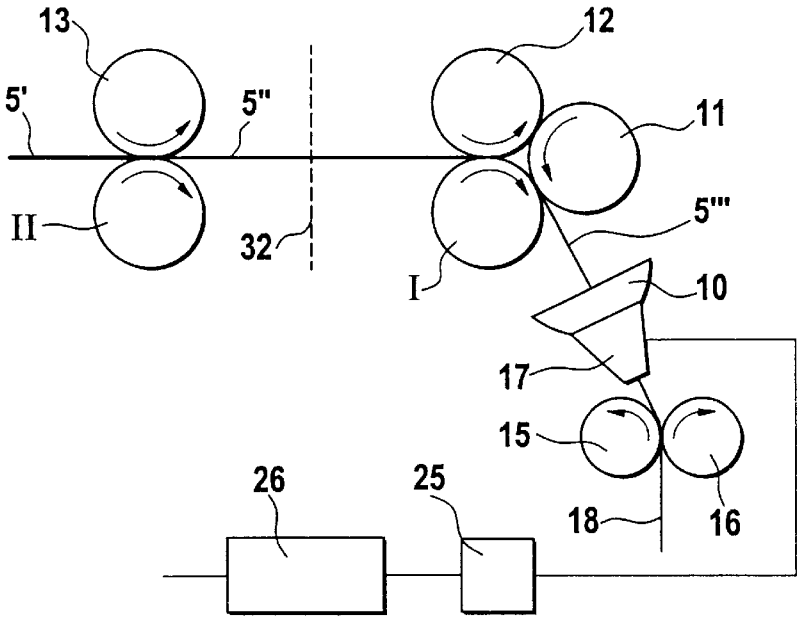
FIG. 2 is an enlarged schematic side elevational view of one part of the FIG. 1 structure, illustrating the principal drafting field with indication of the principal drafting point.

The measured values, for example, thickness fluctuations of the sliver 5, obtained from the measuring member 9 are applied to the memory 31 with a variable delay. As a result of such a delay the change in the draft of the sliver in the principal drafting field according to FIG. 2 occurs at a moment when the sliver region measured earlier by the measuring member 9 and deviating from the desired value is situated in the principal drafting point 32. When such a sliver region reaches the principal drafting point 32 the respective measured value is called from the memory 31.

The distance between the measuring location of the measuring member 9 and the drafting location at the principal drafting point 32 is the application point of regulation R.

The apparatus according to the invention makes possible a direct determination of the setting values for the application point of regulation R. A plurality of measured values of the sliver thickness for different lengths of the exiting sliver 5''' (drafted sliver) are taken from the measuring member 25 in the sliver trumpet, and three CV values ($CV_{1\ m}$, $CV_{10\ cm}$, $CV_{3\ cm}$) are calculated as quality-characterizing magnitudes. In a similar manner the measuring member 9 in the sliver guide 6 takes thickness measurements of a determined length of the un-drafted sliver 5, and from these measured magnitudes quality-characterizing CV values ($CV_{in}$) are calculated.

Figure 3:
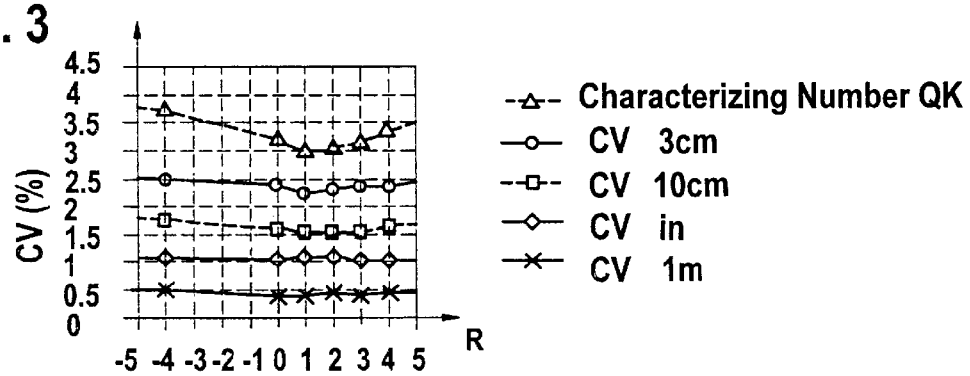
FIG. 3 is a diagram illustrating the effect of the application point of regulation on the on-line CV value.
Figure 4:
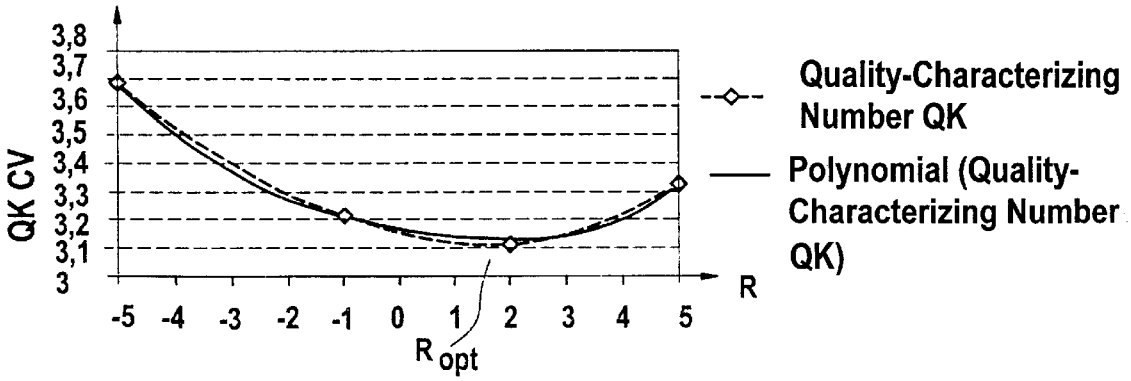
FIG. 4 illustrates a visual representation of an automatic determination of the optimal application point of regulation.

The determination of the CV values occurs preferably for four application points of regulation R. Expediently, in each instance two application points of regulations R are selected on the one side and two application points of regulation R are selected on the other side of the optimal application point of regulation $R_{opt}$. In each instance a quality-characterizing number QK is determined by calculation from the CV values of the un-drafted sliver 5 and the drafted sliver 5'''. Further, a function between the numbers QK and the corresponding application points of regulation R are calculated in the computer 26 and displayed on the screen 27 (FIGS. 3 and 4). A polynomial of the second degree is determined from the four values of the application point of regulation R and the respective quality-characterizing numbers QK, and subsequently the minimum of the curve is calculated. The minimum point of the function corresponds to the optimum application point of regulation $R_{opt}$ (see FIG. 4). In this manner, based on the drafted sliver 5''', several measured values of three different CV values and based on the un-drafted sliver 5, several measured values of a CV value are utilized, and those CV values which correspond to one another in relation to the application point of regulation R are combined to a quality number QK. Based on several quality numbers QK a function is formulated by computation, whose minimum point corresponds to the optimum application point of regulation $R_{opt}$.

During operation, in a setting run or test run, as a first step a predicted first value for the application point of regulation, for example, $R_{-5}$ is set. This value is preferably an empirical value. Inputting may occur by the inputting device 29 or by calling the data from a memory. Subsequently, the following steps are taken:

The sliver quality measured on-line for each setting of an application point of regulation is determined in each instance over a sliver length of 250–300 m.

The measurements for optimizing the application point of regulation are performed on a sliver length without coiler can exchange; this may occur, for example, while the draw frame is at a standstill between the individual application points of regulation R.

The determination of the on-line measured sliver quality is effected based on the following quality values:

Output sliver quality: $CV_{3\ cm}$, $CV_{10\ cm}$, $CV_{1\ m}$ (determined, for example, by a sensor arrangement 25 at the draw frame outlet 4 which may be a SLIVER-FOCUS model manufactured by Trutzschler GmbH & Co. KG).

Input sliver quality is described by $CV_{in}$, (this is performed at the sensor device 9).

From the above different quality values a quality-characterizing number QK is determined by the following formula:

$$QK = CV_{3\ cm} + CV_{10}\ \text{cm} + CV_{1\ cm} - CV_{in}$$

With the above quality-characterizing number a sliver quality is sufficiently determined:

QK high⇒bad quality

QK low⇒good quality.

Based on the QK equation, the natural scattering of the individual values is reduced and outlier values are not evaluated beyond what they are worth. The formation of a mean value leads to more exact predictions, and the influence of the regulation for both long and short wavelengths is taken into consideration. Even the influence of the input quality (sliver 5) is taken into consideration in the computation.

The QK values which are computed from the real CV values obtained during tests are utilized for developing steps 4, 5, 6, 7 and 8 described below.

The course of the quality curve above the application point of regulation R is always symmetrical to the minimum value of the curve (FIG. 3), that is, in case of an optimum application point of regulation R=0, the CV value deterioration at −4 is of the same extent as at +4. The functional relationship is described based on the symmetry by a polynomial of the second degree.

Preferably, the region between −5 and +5 is to be considered so that the quality differences are sufficiently substantial and, at the same time, the level of the application point of regulation remains realistic.

Reductions of three to four values for the application point of regulation R yield sufficient locations of reference (four pieces):

−5 −4 −3 −1 0 1 2 3 4 5

A polynomial of second degree (symmetrical course) is determined, with the aid of numerical solution process, from the four values for the application point of regulation R and the respective QK values.

Thereafter, by means of numeric processes the minimum of the curve is determined.

Such a minimum value is the optimum application point of regulation R in the then applicable machine setting and given fiber material (FIG. 4).

By visual observation (monitor screen 27) an automatic determination of the application point of regulation may be displayed for the operator in a reproducible manner (FIG. 4).

A number of different CV values of different sliver length portions are compared with one another and in addition to the output quality (sliver 5'''), the input quality too, is taken into consideration as an important quality characteristic. Further, the principal drafting point is calculated from the minimum of a polynomial of the second degree, that is, a symmetrical course. Based on an algorithm, several different CV values are combined to a quality-characterizing number QK. From the application points of regulation R and the corresponding quality-characterizing numbers a function is constructed by approximation. The minimum is calculated from the resulting function course. The determination is effected during pre-operational test run or setting run. The optimum application point of regulation $R_{opt}$ is taken over prior to beginning of the regular production by the control system 26, 33 and a consistency inquiry is performed, possibly with error reports, and the result is reproducibly shown to the operator in a graphical representation. Four quality-characterizing numbers QK are obtained for determined application points of regulation R. These four quality-characterizing-numbers are stored in a memory and based thereon a function curve is approximated. only thereafter is the minimum of the function curve calculated. For each quality- number a few meters of sliver are delivered. The quality characterizing magnitude (CV value) is determined between the delivery roll and the location of sliver deposition (output) as well as the measuring device 9 at the draw unit input 3. The test run is performed during the charging of one coiler can. Between the four application points of regulation R (reference locations) the draw frame is stopped. The defined four application points of regulation R have different distances from one another.

The automatic optimization according to the invention of the application point of regulation has, among others, the following advantages:

Faster optimization of the application point of regulation;

Optimization is performed with economy of material;

No need to utilize laboratory equipment or Uster-testers;

CV values for the optimization are no longer distorted by effects such as coiler can deposition, climatic influences, and the like. In this manner, a better optimization result is achieved;

Realization of a "self-optimizing draw frame";

Effective utilization of the machine control system (computer 26);

By means of the automatic optimization the optimum application point of regulation may be found even if the data of the working memory and the data of the mechanical setting do not agree with one another; and Knowledge transfer for performing at the manual optimization to the utilizer (operator) is dispensed with.

By virtue of the automatic determination of the application point of regulation (principal drafting point) not only the sliver uniformity but also, to the same extent, the CV values of the yarn quality may be improved. This was found in wool spinning products and PES/BW mixtures.

The invention was explained in connection with a regulated draw frame 1. It is to be understood that it may find application in other machines which include a regulated draw unit 2, such as a carding machine, a combing machine and the like.

It will be understood that the above description of the present invention is susceptible to various modifications, changes and adaptations, and the same are intended to be comprehended within the meaning and range of equivalents of the appended claims.

What is claimed is:

1. In a method of directly determining setting values for an application point of regulation in a draw unit for drafting sliver; the method including the steps of obtaining a plurality of measured values of a quality-characterizing magnitude of the drafted sliver;

utilizing the measured values for formulating a function having a minimum constituting an optimal application point of regulation for controlling the draw unit;

determining the optimal application point of regulation in a pre-operational run of the draw unit;

the improvement comprising the steps of obtaining at least three of said measured values; and numerically computing a function between the quality-characterizing magnitudes and application points of regulation from said at least three measured values.

2. The method as defined in claim 1, further comprising the step of determining said function as a polynomial.

3. The method as defined in claim 1, further comprising the step of determining said function as a polynomial of the second degree.

4. The method as defined in claim 1, further comprising the step of obtaining said three measured values for a minimum application point of regulation $R_{min}$, a maximum application point of regulation $R_{max}$ and an application point of regulation $R_x$ lying between $R_{min}$ and $R_{max}$.

5. The method as defined in claim 1, wherein at least one measured value is in a negative region $R_{min}$, at least one measured value is in a positive region $R_{max}$ as related to an optimized application point of regulation $R_{opt}$.

6. The method as defined in claim 1, further comprising the step of obtaining four measured values at the most.

7. The method as defined in claim 1, further comprising the step of determining said function as a polynomial of the third degree.

8. The method as defined in claim 1, further comprising the step of obtaining four measured values; further wherein one of said measured values is taken between a minimum application point of regulation $R_{min}$ and an optimal application point of regulation $R_{opt}$ and a further of said measured values is taken between the optimal application point of regulation $R_{opt}$ and a maximum application point of regulation $R_{max}$.

9. The method as defined in claim 1, wherein at least some of the measured values have different distances from one another.

10. The method as defined in claim 1, wherein the sliver advancing in the draw unit has a drafted length portion and an un-drafted length portion; further comprising the steps of obtaining several measured values of a quality-characterizing magnitude based on said un-drafted length portion and determining said function between said quality-characterizing magnitudes and application points of regulation from measured values at said un-drafted length portion and at said drafted length portion.

11. The method as defined in claim 1, wherein said quality-characterizing magnitude is a CV value of the sliver.

12. The method as defined in claim 1, wherein the sliver advancing in the draw unit has a drafted length portion and an un-drafted length portion; further comprising the step of combining corresponding measured values of quality-characterizing magnitudes with respect to the application point of regulation at the un-drafted length portion and at the drafted length portion to a quality-characterizing number QK and forming a function of the quality-characterizing numbers QK; said function having a minimum corresponding to an optimal application point of regulation $R_{opt}$.

13. The method as defined in claim 1, wherein the sliver advancing in the draw unit has a drafted length portion and an un-drafted length portion; further comprising the step of obtaining measured values of at least two quality-characterizing magnitudes based on the drafted length portion; combining values of the quality-characterizing magnitudes at the sliver, which correspond to one another with respect to the application point of regulation, to a quality-characterizing number QK, and forming a function based on several numbers QK; said function having a minimum corresponding to an optimal application point of regulation $R_{opt}$.

14. The method as defined in claim 13, further comprising the steps of determining $R_{opt}$ during a test run, applying $R_{opt}$ to a preliminary drafting control of the draw unit prior to normal operation and performing a plausibility check.

15. The method as defined in claim 1, further comprising the step of obtaining several measured values of at least one quality-characterizing magnitude measured on an un-drafted sliver length portion.

16. The method as defined in claim 1, further comprising the step of establishing the function between quality-characterizing magnitudes and application points of regulation from measured values taken on a drafted sliver length portion and an un-drafted sliver length portion.

17. The method as defined in claim 1, further comprising the step of obtaining two different quality-characterizing magnitudes measured at a drafted sliver length portion.

18. The method as defined in claim 1, further comprising the step of obtaining a plurality of different quality-characterizing magnitudes measured at sliver length portions of different length.

19. The method as defined in claim 1, further comprising the step of obtaining the measured values during a test run of the draw unit within a time period during which one coiler can is filled with sliver as outputted by the draw unit.

* * * * *